United States Patent [19]

Saitoh et al.

[11] Patent Number: 4,705,730

[45] Date of Patent: Nov. 10, 1987

[54] LIGHT-RECEIVING MEMBER

[75] Inventors: Keishi Saitoh, Ibaraki; Tetsuo Sueda, Chofu; Kyosuke Ogawa, Tokyo; Teruo Misumi, Kawasaki; Yoshio Tsuezuki, Toride; Masahiro Kanai, Tokyo, all of Japan

[73] Assignee: Canon Kabushiki Kaisha, Tokyo, Japan

[21] Appl. No.: 739,867

[22] Filed: May 31, 1985

[30] Foreign Application Priority Data

Jun. 4, 1984 [JP] Japan ..... 59-113175

[51] Int. Cl.[4] ..... G03G 5/085

[52] U.S. Cl. ..... 430/57; 430/69; 430/84

[58] Field of Search ..... 430/56, 57, 58, 65, 430/69, 84, 127

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Mimura et al. | 430/67 |
| 4,514,483 | 4/1985 | Matsuura et al. | 430/84 |
| 4,592,981 | 6/1986 | Saitoh et al. | 430/69 |
| 4,592,983 | 6/1986 | Saitoh et al. | 430/69 |
| 4,595,644 | 6/1986 | Saitoh et al. | 430/69 |
| 4,600,671 | 7/1986 | Saitoh et al. | 430/69 |

FOREIGN PATENT DOCUMENTS

| | | | |
|---|---|---|---|
| 2733187 | 1/1978 | Fed. Rep. of Germany | 430/65 |
| 56-150754 | 11/1981 | Japan | 430/65 |
| 60-31144 | 2/1985 | Japan | 430/69 |

*Primary Examiner*—John L. Goodrow

*Attorney, Agent, or Firm*—Fitzpatrick, Cella, Harper & Scinto

[57] ABSTRACT

A light-receiving member comprises a substrate having a large number of projection parts, whose cross-sectional shape at a given cross-sectional position is a projection shape formed of a main peak and an auxiliary peak as overlapped, on the surface of the substrate, and a light-receiving layer comprising a layer containing an amorphous material including silicon atoms, at least one part of the layer region of the layer being photosensitive, and a surface layer having a reflection-preventive function.

An electrophotographic system comprises the above-mentioned light-receiving member.

29 Claims, 22 Drawing Figures

LIGHT-RECEIVING MEMBER

CROSS-REFERENCE TO RELATED APPLICATIONS

This application contains subject matter related to commonly assigned, copending application Ser. Nos. 697,141, 699,868; 705,516; 709,888; 720,011; 740,901; 786,970; 717,821; 719,980, 725,751; 726,768, 740,714; 741,300; 753,048; 753,011 and 752,920.

BACKGROUND OF THE INVENTION

1. Field of the Invention

This invention relates to a light-receiving member sensitive to electromagnetic waves such as light in a broad sense, including ultra-violet rays, visible radiation, infra-red rays, X-rays, $\alpha$-rays, etc., and more particularly to a light-receiving member suitable for applications of coherent light such as laser beam, etc.

2. Decription of the Prior Art

A well known method for recording digital image information as an image comprises optically scanning a light-receiving member with a laser beam modulated according to digital image information, thereby forming an electrostatic latent image, then developing the image, and, if necessary, conducting transfer, fixation, etc. of the developed image, thereby recording the image. Among them, a method for forming an image by electrophotography generally records an image, using such a laser as a small and cheap He-Ne laser or semi-conductor laser usually having an emission wavelength of 650–820 nm. As a light-receiving member for electrophotography suitable for applications of a semi-conductor laser, the light-receiving member comprising an amorphous material containing silicon atoms (hereinafter written briefly as "A-Si") as disclosed, for example, in Japanese Laid-open Patent Application No. 86341/1979 or Japanese Laid-open Patent Application No. 83746/1981 is attracting attention for its high Vickers hardness and non-polluting properties in social aspect in addition to the advantage of being by for superior in matching in its photosensitive range as compared with other kinds of light-receiving member.

However, when the photo-sensitive layer is made up of a single A-Si layer, it is necessary that hydrogen atoms or halogen atoms, or boron atoms in addition to thereto are structurally contained in the layer in controlled amounts within specific ranges to obtain a dark resistance of $10^{12}$ Ω.cm or higher required for the electrophotography while maintaining a high photosensitivity. Thus, there is considerable restrictions to the design allowance of light-receiving member such as the necessity for strict control of layer formation, etc.

It has been already proposed to enlarge the design allowance, that is, to effectively utilize the high photosensitivity even if the dark resistance in somewhat low. For example, light-receiving members having an improved apparent dark resistance have been proposed by making up the light-receiving layer of two or more laminated layers having different photoconductive characteristics, thereby forming a vacant layer in the light-receiving layer, as disclosed in Japanese Laid-open Patent Application Nos. 121743/1979, 4053/1982 and 4172/1982, or by providing a light-receiving layer between the substrate and the photo-sensitive layer and/or by providing a barrier layer on the upper surface of the photo-sensitive layer, thereby making the light-receiving member of multi-layer structure, as disclosed in Japanese Laid-open Patent Application Nos. 52178/1982, 52179/1982, 52180/1982, 58159/1982, 58160/1982 and 58161/1982.

According to such proposals, the A-Si type light-receiving members have been drastically advanced in tolerance in designing of commercialization thereof as well as in easiness in management of the production and productivity, and the speed of developement toward commercialization is now further accelerated.

When laser recording is carried out with such a light-receiving member having the light-receiving layer of multi-layer structure, there is a possibility of occurence of interferences of reflected lights from the free surface on the laser beam irradiation side of the light-receiving layer and the layer interfaces between the individual layers making up the light-receiving layer and between the substrate and the light-receiving layer (hereinafter "interface" is used to mean comprehensively both the free surface and the layer interface) because the individual layers are not uniform in thickness and the laser beam is an coherent monochromatic light.

The interference phenomenon appears on the formed visibible image as the so called interference fringe pattern, and deteriorates the image. Particularly in the case of forming a halftone image with high gradation, the image becomes considerably poor. Moreover, as the wavelength region of the applied semi-conductor laser beam is shifted to a longer wavelength, the absorption of the laser beam in the photo-sensitive layer is reduced, and thus the interference phenomenon becomes more pronounced. This point is described in detail, refering to the drawings.

FIG. 1 shows a light $I_0$ incident upon a certain layer making up the light-receiving layer of a light-receiving member, a reflected light $R_1$ from the upper interface 102 and a reflected light $R_2$ from the lower interface 101.

Now, an average layer thickness of the layer is defined as d, a refractive index as n, and a light wavelength as $\lambda$, and when the layer thickness of a certain layer is ununiform gently within a layer thickness difference of $\lambda/2n$ or more, the light absorption quantity and light transmission quantity change, depending on whether the reflected lights $R_1$ and $R_2$ conform the condition of $2nd=m\lambda$(m: an integer, where the reflected lights are strengthened with each other) or the condition of $2nd=(m+\frac{1}{2})\lambda$(m: an integer, where the reflected lights are weakened with each other).

In the light-receiving member of multi-layer structure, the interference effect shown in FIG. 1 occurs in each layer, and a synergistically adverse effect due to the individual interferences occurs, as shown in FIG. 2. Thus, the interference fringes corresponding to the interference fringe pattern appear on a visible image transferred and fixed on a transfer member, deteriorating the image.

To overcome the disadvantage, various methods have been proposed, for example, a method for forming a light scattering surface by diamond-cutting the surface of a substrate thereby providing unevenness of ±500 Å to ±10,000 Å (Japanese Laid-open Patent Application No. 162975/1983), a method for providing a light absorption layer by subjecting the aluminum substrate surface to black Alumite treatment or by dispersing carbon, coloring pigment or dye into the resin (Japanese Laid-open Patent Application No. 165845/1982), a method for providing a light scattering or reflection-preventive layer on the surface of substrate by subjecting the aluminum substrate surface to satin-like Alumite treatment or by providng a sandy fine uneveness by sand blast (as disclosed in Japanese Laid-open Patent Application No. 16554/1982), and the like.

However, the interference fringe pattern appearing on the image cannot be completely eliminated according to these conventional methods. That is, the first method can indeed prevent the occurrence of the interference fringe pattern by virture of the effect of light scattering, because a large number of projections and recesses within a specific range of sizes are provided on the substrate surface, but the regularly reflected light components still exist in the light scattering and thus there remains the interference fringe pattern due to said regularly reflected light. In addition, the irradiated sports are enlarged due to the light scattering effect on the substrate surface, resulting in lowering of substantial resolution.

The electrolytic oxidation of the aluminum substrate into black according to the second method cannot attain complete absorption, and thus the reflected light still remains on the substrate surface. In the case of providing the coloring pigment-despersed resin layer, the resin layer is deaerated when the A-Si photo-sensitive layer is formed, resulting in considerable lowering of the quality of the formed photo-sensitive layer, and also the resin layer is damaged by the plasma when the A-Si based photo-sensitive layer is formed, resulting in lowering of the proper absorption function and deterioration of the surface state, giving an adverse effect on the successive formation of A-Si based photo-sensitive layer .

In the third method for irregularly roughering the substrate surface, as shown in FIG. 3, for example, the incident light $I_0$ is partly reflected on the surface of light-receiving layer 302 to form reflected light $R_1$, while the remaining incident light advances into the light-receiving layer 302 to form transmitted light $I_1$. The transmitted light $I_1$ is partially scattered on the surface of substrate 302 to partially form diffused lights $K_1$, $K_2$, $K_3$ . . . as a result of light scattering, while the remaining transmitted light is regularly reflected to form reflected $R_2$, a part of which is emitted to the outside as outgoing light $R_3$. Thus, the outgoing light $R_3$ which is a component interferable with the reflected light $R_1$, remains, and thus the interference fringe pattern cannot be completely eliminated yet.

When the surface diffusibility of substrate 301 is increased to prevent multiple reflection within the light-receiving layer to prevent the interference, the light is diffused within the light-receiving layer, causing halation and lowering the resolution.

Particularly in the light-receiving member of multi-layer structure, as shown in FIG. 4, the reflected light $R_2$ on the first layer 402, the reflected light $R_1$ on the second layer, and the regularly reflected light $R_3$ on the surface of substrate 401 interfere with one another to form interference fringe patterns according to the thickness of each layer in the light-receiving member, even if the surface of substrate 401 is irregularly roughened. Thus, in the light-receiving member of multi-layer structure, the interference fringes cannot be completely prevented by irregular roughening of the surface of substrate 401.

In the case of irregular roughening of the substrate surface by sand blasting, etc., the roughness much fluctuates between lots, and even one and same low cannot have an even roughness, giving an inconvenience to the production control. In addition, there are many chances to form relatively large projections at random, which cause a local breakdown in the light-receiving layer.

In the case of mere regular roughening of the surface of substrate 501, as shown in FIG. 5, the light-receiving layer 502 is formed along the uneven shape on the surface of substrate 501 and thus the projections and recesses of the surface of substrate 501 will be in parallel with the projections and recesses of the surface of light-receiving layer 502.

Thus, $2nd_1=m\lambda$ or $2nd_1=(m+\frac{1}{2})\lambda$ is valid for the incident light at these surfaces to form bright or dark fringes, respectively. Throughout the entire light-receiving layer, there is such an unevenness in the layer thickness that a maximum difference between the individual layer thicknesses of light-receiving layer, $d_1$, $d_2$, $d_3$ and $d_4$, is more than $\lambda/2n$ , and thus bright and dark fringe patterns appear. Thus, occurrence of interference fringe patterns cannot be completely prevented merely by roughening the surface of substrate 501.

In the case of forming a light-receiving layer of multi-layer structure on the regularly roughened substrate surface, interferences of reflected lights at the interfaces between the individual layers intract together with the interference between the regularly reflected light on the substrate surface and the reflected light on the light-receiving layer surface, as in FIG. 3, referring to the light-receiving member of single layer structure. Thus, the interference fringe patterns as occurred will be more complicated than that is the light-receiving member of single layer structure.

SUMMARY OF THE INVENTION

An object of the present invention is to provide a novel light-receiving member sensitive to light, which has cancelled the drawbacks as described above.

Another object of the present invention is to provide a light-receiving member which is suitable for image formation by use of a coherent monochromatic light and also easy in production management.

Still another object of the present invention is to provide a light-receiving member which can cancel the interference fringe pattern appearing during image formation and appearance of speckles on reversal developing at the same time and completely.

Further object of the present invention is to provide a light-receiving member capable of conducting a digital image recording by use of electrophotography, particularly a clean, digital image recording having half-tone information with a high resolution and a high quality.

Still further object of the present invention is to provide a light-receiving member having a high photosensitivity, a high SN ratio characteristic, and a good electric contact with a substrate.

Still further object of the present invention is to provide a light-receiving member capable of reducing light reflection on the surface of light-receiving member, and efficiently utilizing an incident light.

According to one aspect of the present invention, there is provided a light-receiving member which comprises a substrate having a large number of projection parts, whose cross-sectional shape at a given cross-sectional position is a projection shape formed of a main peak and an auxiliary peak as overlapped, on the surface of the substrate, and a light-receiving layer comprising a layer containing an amorphous material including silicon atoms, at least one part of the layer region of the layer being photosensitive, and a surface layer having a reflection-preventive function.

According to another aspect of the present invention, there is provided an electrophotographic system which comprises the above-mentioned light-receiving member.

DETAILED DESCRIPTION OF PREFERRED EMBODIMENTS

Figure 1:
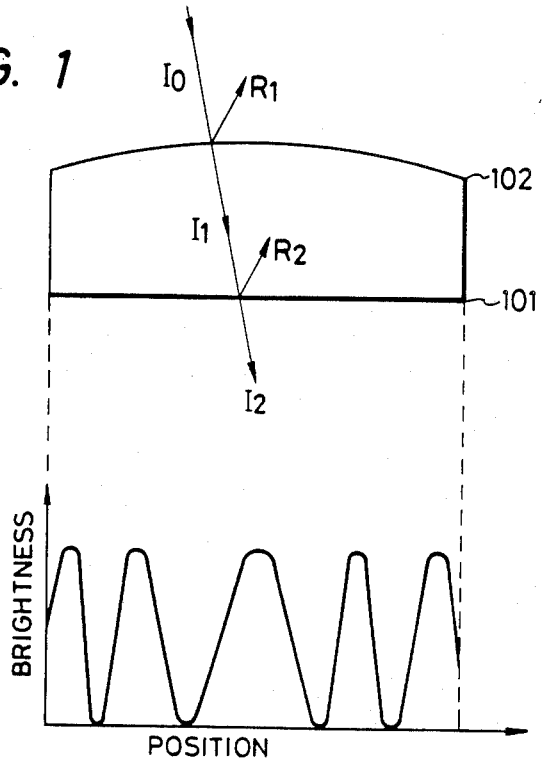
FIG. 1 is a schematic illustration of interference fringe in general.
Figure 2:
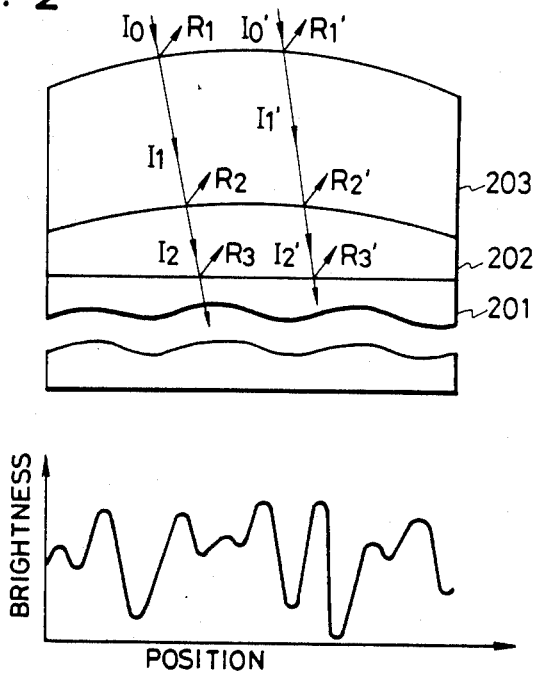
FIG. 2 is a schematic illustration of interference fringe in the case of a multi-layer light-receiving member.
Figure 3:
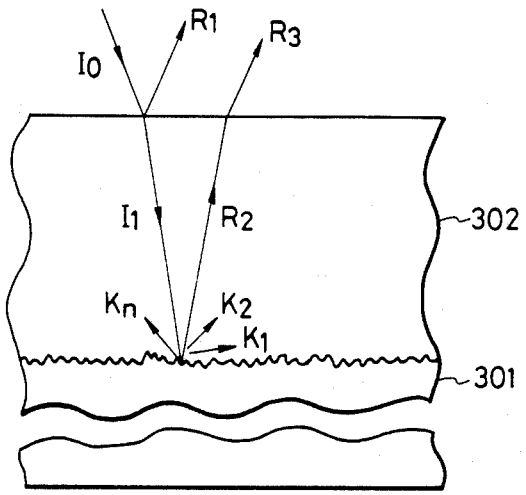
FIG. 3 is a schematic illustration of interference fringe by scattered light.
Figure 4:
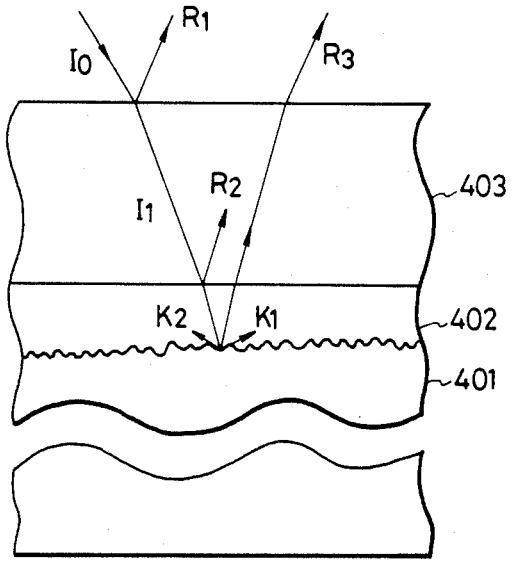
FIG. 4 is a schematic illustration of interference fringe by scattered light in the case of a multi-layer light-receiving member.
Figure 5:
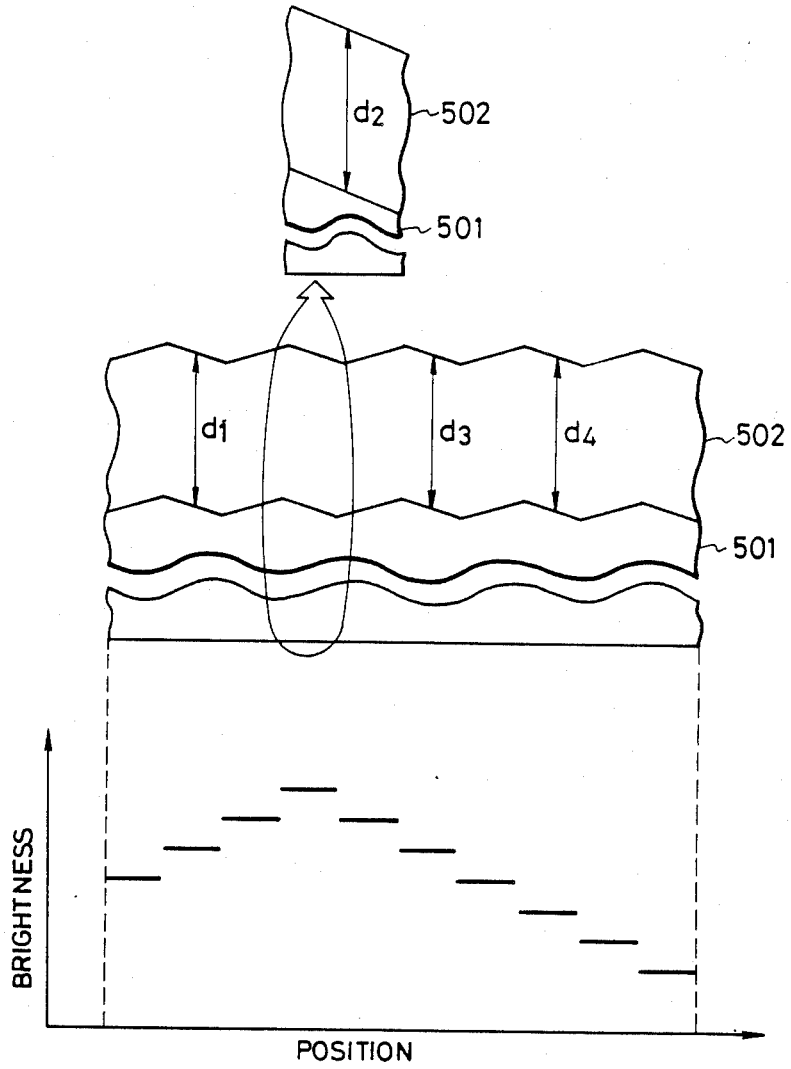
FIG. 5 is a schematic illustration of interference fringe in the case where the interfaces of respective layers of a light-receiving member are parallel to each other.

The present invention is described in detail below, referring to the drawings.

FIG. 6 is a schematic view showing the basic principle of the present invention.

Figure 6A:
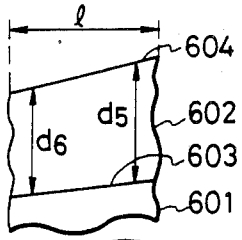
FIGS. 6A–6D are schematic illustrations of no appearance of interference fringe in the case of non-parallel interfaces between respective layers of a light-receiving member.
Figure 6B:
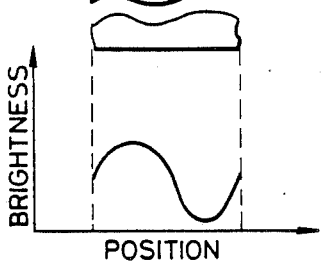
Figure 6C:
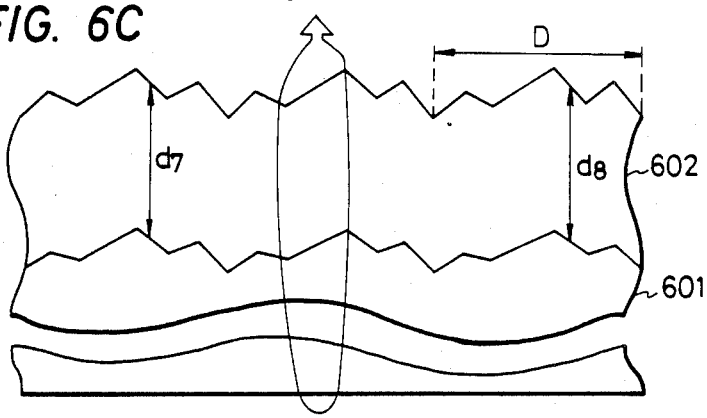
Figure 6D:
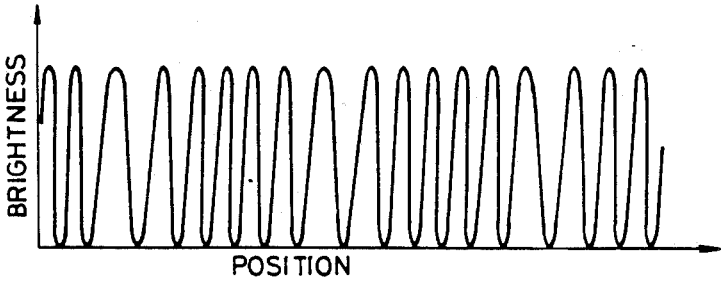

In a light-receiving layer of multi-layer structure having at least one photo-sensitive layer laid on a substrate having finer uneven shapes (shown below in the drawing) than the required resolution of an apparatus along the inclined surface of the projections and recesses of the substrate according to the present invention, the layer thickness of second layer 602 continuously changes, for example, from $d_5$ to $d_6$, as shown in the enlarged view of FIG. 6(A), and thus the interfaces 603 and 604 have inclinations, respectively. Thus, an coherent light incident or the infinitesimal region (short range) l undergoes interference in said infinitesimal region l to form a finer interference fringe pattern.

Figure 7A:
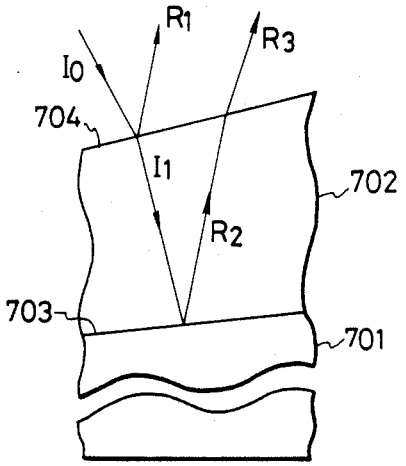
FIGS. 7A–7C are schematic illustrations of comparison of the reflected light intensity between the case of parallel interfaces and non-parallel interfaces between the respective layers of a light-receiving member.
Figure 7B:
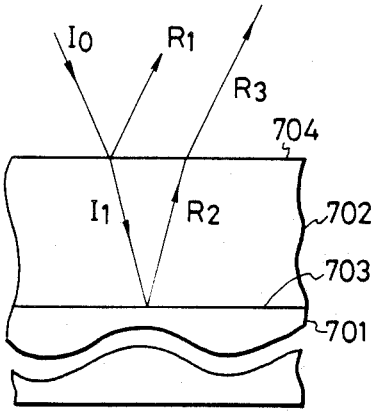

When the interface 703 between the first layer 701 and the second layer 702 and the free surface 704 of second layer 702 are not in parallel with each other, as shown in FIG. 7, the reflected light $R_1$ to the incident light $I_0$ as in FIG. 7(A), and the outgoing light $R_3$ advance in different directions, and thus the degree of interference is reduced, as compared with the case where the interfaces 703 and 704 are in parallel with each other (FIG. 7(B)).

Figure 7C:
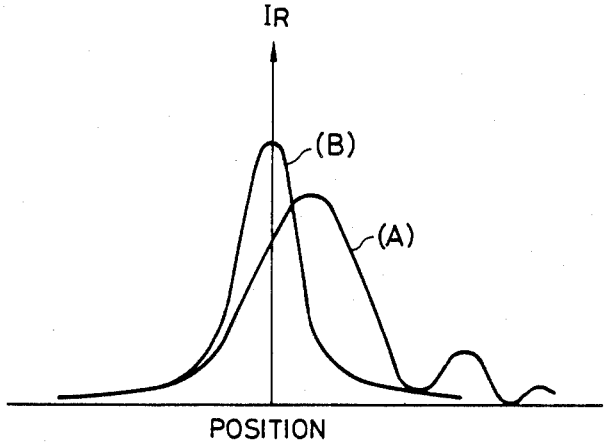

Thus, the difference in the bright and dark fringes in the interference fringe pattern can be neglibly small in the case FIG. 7(A) where a pair of interfaces are not in parallel with each other, even if interfered, as compared with the case FIG. 7(B) where they are in parallel, as shown in FIG. 7(C). As a result, the incident light quantity in the infinitesimal region can be made even. This is also true of the case where the layer thickness of second layer 602, as shown in FIG. 6, is microscopically uneven ($d_7 \neq d_8$), and thus the incident light quantity can be made even throughout the entire layer region (see FIG. 6(D)).

Figure 8:
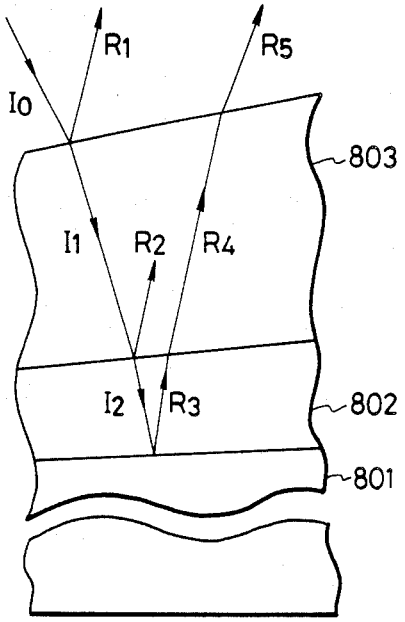
FIG. 8 is a schematic illustration of no appearance of interference fringe in the case of non-parallel interfaces between respective layers.

In the case of a light-receiving layer of multi-layer structure, there are reflected lights $R_1$, $R_2$, $R_3$, $R_4$ and $R_5$ to the incident light $I_0$, as shown in FIG. 8, when the interferable light is transmitted from the irradiation side to the second layer, and the phenomena, as explained with reference is FIG. 7, will occur in the individual layers. Furthermore, the interface of each layer in the infinitesimal region works as a kind of a slit to cause a diffraction phenomenon. In the interference in each layer, an effect as a product of the interference due to the diffraction in layer thickness and the interference due to the diffraction at the layer interface thus appears. That is, the interference throughout the entire light-receiving layer appears as a synergistic effect of individual layers, and thus the interference can be much more prevented by increasing the number of layers for a light-receiving layer according to the present invention.

The interference fringes formed in the infinitesimal region do not appear on an image, because the size of the infinitesimal region is smaller than the spot size of irradiated light, that is, smaller than the resolution limit. Even if the interference fringes appear on the image, they are less than the eye resolution, and thus give no substantial troubles.

In the present invention, it is desirable that the inclined surfaces of projections and recesses are of mirror surface finish to emit the reflected lights in one direction without fail.

The suitable size l of the infinitesimal region according to the present invention (one cycle of uneven shape) is in a relationship of $l \leqq L$, where L is the spot size of irradiated light.

To effectively attain the objects of the present invention, it is desirable that the difference in layer thickness ($d_5$–$d_6$) in the infinitesimal region l is in a relationship of $d_5 - d_6 \geqq \lambda/2n$, where $\lambda$ is the wavelength of irradiated light and n is the refractive index of second layer 602.

In the light-receiving layer of multi-layer structure recording to the present invention, the layer thickness of individual layers in a layer thickness direction (which is a hereinafter referred to as "infinitesimal column") in the infinitesimal region l in controlled so that at least two of layer interfaces may be not in parallel with each other in the infinitesimal column. So long as this requirement is satisfied, any two of the layer interfaces can be in parallel with each other in the infinitesimal column.

However, it is desirable that the layers for forming parallel layer interfaces can be formed with an uniform layer thickness throughout the entire region so that the difference in layer thickness at any two positions may be less the $\lambda/2n$, where n is the refractive index of layer.

To more effectively and easily attain the objects of the present invention, the plasma vapor phase process (PCVD process), the photoCVD process, and the heat CVD process can be applied to formation of individual layers of a light-receiving layer, i.e. a photo-sensitive layer, a charge injection-preventive layer, a barrier layer formed from an electrically insulating material, etc. in view of exact controllability of layer thickness on an optical level.

The substrate for use in the present invention can be processed according to a chemical process such as chemical ething, electro-plating, etc.; a physical process such as vapor deposition, sputtering, etc.; a mechanical process, such as lathe machining, etc. For easy production control, the mechanical process such as lathe machining, etc. is preferable.

When a substrate is processed, for example, by a cutting machine, a cutting tool having a V-shaped cutting blade is fixed at the predetermined positions of the cutting machine such as a lathe, a milling machine, etc., and the substrate surface is exactly cut or scraped by regularly moving, for example, a cylindrical substrate in the desired direction while rotating it according to a preset program, whereby the desired shapes with projections and recesses can be obtained at the desired pitch with the desired depth. The linear projection resulting from the uneven shapes formed by machining as mentioned above has a spiral structure at the center axis of the cylindrical substrate. The spiral structure of the projection may be a multiple spiral structure such as double and triple structures, or a cross-spiral structure, or the spiral structure can have a straight line structure along the center axis.

To enhance the effect of the present invention and facilitate the processing control, it is desirable that the projection parts in the desired cross-sections of the present substrate take the same shape in a linear approximation.

To enhance the effect of the present invention, it is desirable that the projection parts are arranged regularly or at constant pitches. To further enhance the effect of the present invention and enhance the adhesion between the light-receiving layer and the substrate, it is desirable that the projection parts have a plurality of auxiliary peaks.

Figure 9A:
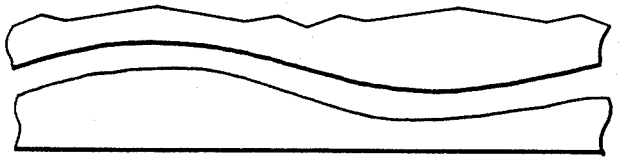
FIGS. 9 (A) and (B) are schematic illustrations of the surface condition of typical substrates, respectively.
Figure 9B:
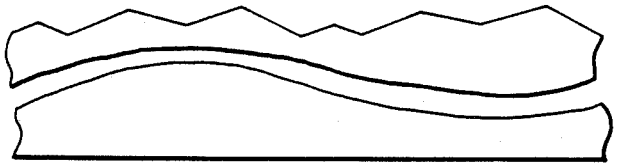

To more efficiently scatter the incident light in one direction it is desirable, in addition to the above, that the projection parts are unified to be symmetric at the main peak as a center (FIG. 9 (A)) or asymmetric (FIG. 9(B)). To enhance the degree of freedom in the processing control of a substrate, it is preferable to provide both symmetric and asymmetric projection parts at the same time.

In the present invention, the individual dimensions of projections and recesses to be provided on the substrate surface in a controlled state are selected in view of the following points so that the objects of the present invention can be effectively attained.

In the first place, the A-Si layer for forming a photosensitive layer is structurally very sensitive to the state of a surface on which the layer is formed, and the layer quality greatly depends on the surface state. Thus, it is necessary to select the dimentions of the projection and recess parts to be provided on the substrate surface so as not to lower the quality of the A-Si photosensitive layer.

In the second place, when there are extremely pronounced projections and recesses on the free surface of a light-receiving layer, cleaning cannot be carried out completely after the image formation. In the case of blade cleaning, there is still a problem of rapid damage of the blade.

As a result of studies of the foregoing problems concerning the layer deposition and electrophotographic process and conditions for preventing the interference fringe pattern, the pitch for the recess parts on the substrate surface is preferably 500 to 0.3 μm, more preferably 200 to 1 μm, most preferably 50 to 5 μm. The maximum depth of the recess parts is preferably 0.1 to 5 μm, more preferably 0.3 to 3 μm, most preferably 0.6 to 2 μm. When the pitch and the maximum depth of the recess parts on the substrate surface are kept within said ranges, the inclination of inclined surfaces of recess parts (or linear projections) is preferably 1 to 20 degrees, more preferably 3 to 15 degrees, most preferably 4 to 10 degrees.

The maximum defference in layer thickness due to an uniformness in layer thickness of the individual layers to be deposited on such a substrate is preferably 0.1 to 2 μm, more preferably 0.1 to 1.5 μm, most preferably 0.2 to 1 μm when the pitches are identical throughout.

The thickness of a surface layer having a reflection-preventive function is selected as follows:

Preferable thickness d for a surface layer having a reflection-preventive function can be give by the following formula:

$$d = \frac{\lambda}{4n}$$

where n is the refractive index of the material for the surface layer, λ is the wavelength of irradiated light, and m is an odd number.

Suitable material for the surface layer must have a refractive index given by the following formula:

$$n = \sqrt{na}$$

where na is the refractive index of a photo-sensitive layer deposition on the surface layer.

In view of the foregoing optical conditions, the thickness of a reflection-preventive layer is preferably 0.05 to 2 μm on the presumption that the wavelength of irradiation light is in the range of near infrared to visible lights.

Effective materials for the surface layer having a reflection-preventive function according to the present invention include, for example, inorganic fluorides, inorganic oxides, and inorganic nitrides such as $MgF_2$, $Al_2O_3$, $ZrO_2$, $TiO_2$, ZnS, $CeO_2$, $CeF_2$, $SiO_2$, SiO, $Ta_2O_5$, $AlF_3$, NaF, $Si_3N_4$ and the like, and organic compounds such as polyvinyl chloride, polyamide resin, polyimide resin, vinylidene fluoride, melanine resin, epoxy resin, phenol resin, cellulose acetate, etc.

The layer thickness of these material can be exactly controlled on an optical level, thereby effectively and easily attaining the objects of the present invention, and thus the vapor deposition process, the sputtering process, the plasma vapor phase process (PCVD process), the light CVD process, the heat CVD process and a coating process can be applied to these materials.

A specific embodiment of the present light-receiving member of multi-layer structure is given below.

Figure 10:
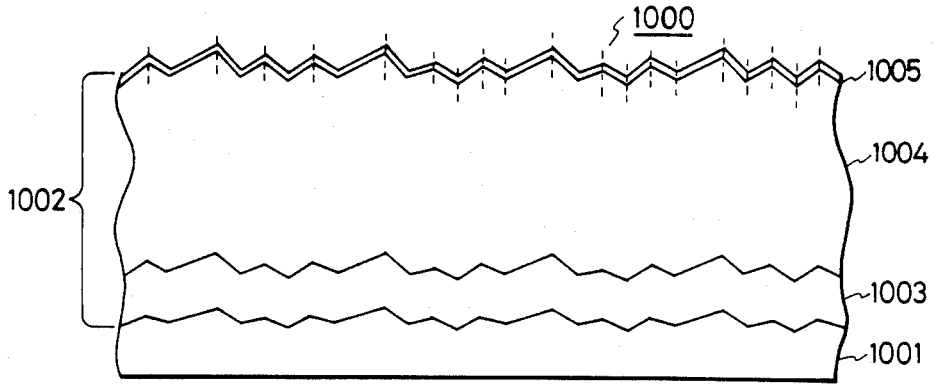
FIG. 10 is a schematic illustration of the layer constitution of a light-receiving member.

A light-receiving member 1000 shown in FIG. 10 comprises a substrate 1001 so subjected surface-cutting as to attain the objects of the present invention, and a light-receiving layer 1002 deposited thereon, the light-receiving layer 1002 comprising a change injection-preventive layer 1003, a photo-sensitive layer 1004, and a surface layer 1005, as arranged in the order from the side of the substrate 1001.

The substrate 1001 may be electroconductive or electrically insulating, and the electroconductive substrate may be made from metals such as NiCr, stainless steel, Al, Cr, Mo, Au, Nb, Ta, V, Pt, Pd, etc., or their alloys. The electrically insulating substrate may be made of a film or a sheet of synthetic resin such as polyester, polyethylene, polycarbonate, cellulose acatete, polypropylene, polyvinyl chloride, polyvinylidene chloride, polystyrene, polyamide, etc.; and glass, ceramics, paper, etc. It is desirable that at least one surface of the electrically insulating substrate is treated to be electroconductive and other layers are provided on the surface side rendered electroconductive.

For example, in the case of glass, a film of NiCr, Al, Cr, Mo, Au, Ir, Nb, Ta, V, Ti, Pt, Pd, $In_2O_3$, $SnO_2$, ITO ($In_2O_3+SnO_2$), or the like is provided on its surface to give an electroconductivity to the surface, or in the case of a synthetic resin film such as a polyester film or the like, a film of metal such as NiCr, Al, Ag, Pd, Zn, Ni, Au, Cr, Mo, Ir, Nb, Ta, V, Ti, Pt, or the like is provided on its surface by vacuum vapor deposition, electron beam vapor deposition, sputtering, etc., or its surface is laminated with the metal to give electroconductivity to the surface. The substrate can take any shape such as cylindrical, belt-shaped, plate-shaped, etc., and its shape can be selected as desired. For example, when the light-receiving member 1000 in FIG. 10 is used as an image-forming member for electrophotography, the substrate is desirably in an endless belt shape or cylindrical shape in the case of continuous copying. The thickness of a substrate is selected so that the desired light-receiving member can be formed. When the light-receiving member requires a flexibility, the substrate can be made as thin as possible, so far as the function of a substrate can be performed without any trouble. However, in such a case, the thickness of a substrate is preferably 10 μm or more in view of the production and handling facility, mechanical strength, etc. of the substrate.

The change injection-preventive layer 1003 is provided to prevent change injection from the side of 1001 into the photo-sensitive layer 1004, thereby making an apparent resistance higher.

The charge injection-preventive layer 1003 is made of A-Si containing hydrogen atoms and/or halogen atoms (X) [which is hereinafter referred to as "A-Si (H,X)"] and contains a conductivity-controlling substance (C). The conductivity-controlling substance (C) contained in the charge injection-preventive layer 1003 includes the so called inpurity in the semi-conductor field, and includes p-type inpurities giving p-type conductive characteristics to Si, and n-type inpurities giving n-type conductive characteristics to Si. More specifically, the p-type impurities include atom species belonging to group III of the periodic table (group III atoms) such as B (boron), Al(aluminum), Ga (gallium), In (indium), Tl (thallium), etc. Particularly preferably used are B and Ga.

The n-type inpurities include atom species belonging to group V of the periodic table (group V atoms), such as P (phosphorus), As (arsenic), Sb (antimony), Bi (bismuth), etc. Particularly preferably used are P and As.

The content of the conductivity-controlling substance (C) contained in the charge injection-preventive layer 1003 can be selected as desired in view of the desired charge injection-preventive characteristics, or in view of such organic relationships such as a relationship to the contact interface characteristics with the substrate 1001 in the case where the charge injection-preventive layer 1003 is provided in direct contact with the substrate 1001. Furthermore, the content of the conductivity-controlling substance (C) can be selected as desired in view of relationships to the layer region characteristics and the contact interface characteristics with other layer region in addition to the case where the charge injection-preventive layer is provided in direct contact with the substrate.

In the present invention, the content of the conductivity-controlling substance (C) contained in the charge injection-preventive layer is preferably 0.001 to $5\times10^4$ atomic ppm, more preferably 0.5 to $1\times10^4$ atomic ppm, most preferably 1 to $5\times10^3$ atomic ppm.

By adjusting the content of the substance (C) in the charge injection-preventive layer 1003 preferably to 30 atomic ppm or more, more preferably to 50 atomic ppm or more, most preferably to 100 atomic ppm or more in the present invention, transfer of electrons to be injected into the photo-sensitive layer from the substrate side when the free surface of the light-receiving layer is subjected to charging treatment to ⊕ polarity can be more effectively prevented in the case where the substance (C) to be contained is said p-type impurities, or transfer of positive holes to be injected into the photo-sensitive layer from the substrate side when the free surface of the light-receiving layer is subejcted to charging treatment to ⊖ polarity can be more effectively prevented in the case where the substance (C) to be contained is said n-type impurities.

The thickness of charge injection-preventive layer 1003 is preferably 30 Å to 10 μm, more preferably 40 Å to 8 μm, most preferably 50 Å to 5 μm.

The photo-sensitive layer 1004 is made of A-Si (H, X) and has both charge-generating function to generate photo-carriers by irradiation of laser beam and charge-transporting function to transport the charges.

Thickness of photo-sensitive layer 1004 is preferably 1 to 100 μm, more preferably 1 to 80 μm, most preferably 2 to 50 μm.

The photo-sensitive layer 1004 can contain a substance capable of controlling another polarity than that of the conductivity-controlling substance (C) contained in the charge injection-preventive layer 1003, or can contain the conductivity-controlling substance of same polarity in a much less amount than the actual amount in the charge injection-preventive layer 1003. In such a case, the content of the conductivity-controlling substance contained in the photosensitive layer 1004 can be selected as desired in view of the polarity and the content of the substance contained in the charge injection-preventive layer 1003, and is preferably 0.001 to 1,000 atomic ppm, more preferably 0.05 to 500 atomic ppm, most preferably 0.1 to 200 atomic ppm.

When the same kind of conductivity-controlling substance (C) is contained in the charge injection-presentive layer 1003 and the photo-sensitive layer 1004 in the present invention, the content of the substance in the photo-sensitive layer 1004 is preferably 30 atomic ppm or less.

In the present invention, the amount of hydrogen atoms (H) or halogen atoms (X) or the total amounts of hydrogen atoms (H) and halogen atoms (X) contained in the charge injection-preventive layer 1003 and the photo-sensitive layer 1004 is preferably 1 to 40 atomic %, more preferably 5 to 30 atomic %.

The halogen atoms include F, Cl, Br and I, especially, F and Cl are preferable.

The light-receiving member FIG. 10 can have the so called barrier layer made of an electrically insulating material in place of the charge injection-preventive layer 1003, or can have both barrier layer and charge injection-preventive layer 1003.

The material for forming a barrier layer includes inorganic electrically insulating materials such as $Al_2O_3$, $SiO_2$, $Si_3N_4$, etc., and organic electrically insulting materials such as polycarbonate, etc.

The present invention will be described in detail below, referring to Examples.

EXAMPLE 1

In this example, a spot-based semi-conductor laser of 80 μm (wavelength: 780 nm) was used. A spiral groove was formed by a lathe on a cylindrical Al substrate [357 mm long (L) and 80 mm in diameter (r)] for building up A-Si:H.

Figure 11A:
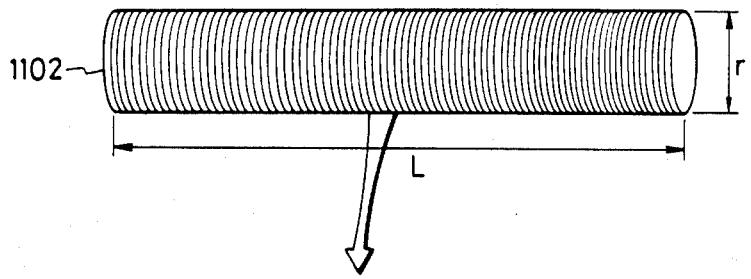
FIGS. 11A–11C, FIG. 14, FIG. 15 and FIG. 16 are schematic illustrations of the surface state of the aluminum substrates employed in Examples.
Figure 11B:
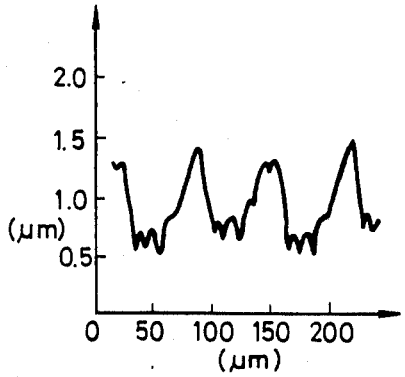

The cross-sectional shape of the groove is shown in FIG. 11(B).

Figure 12:
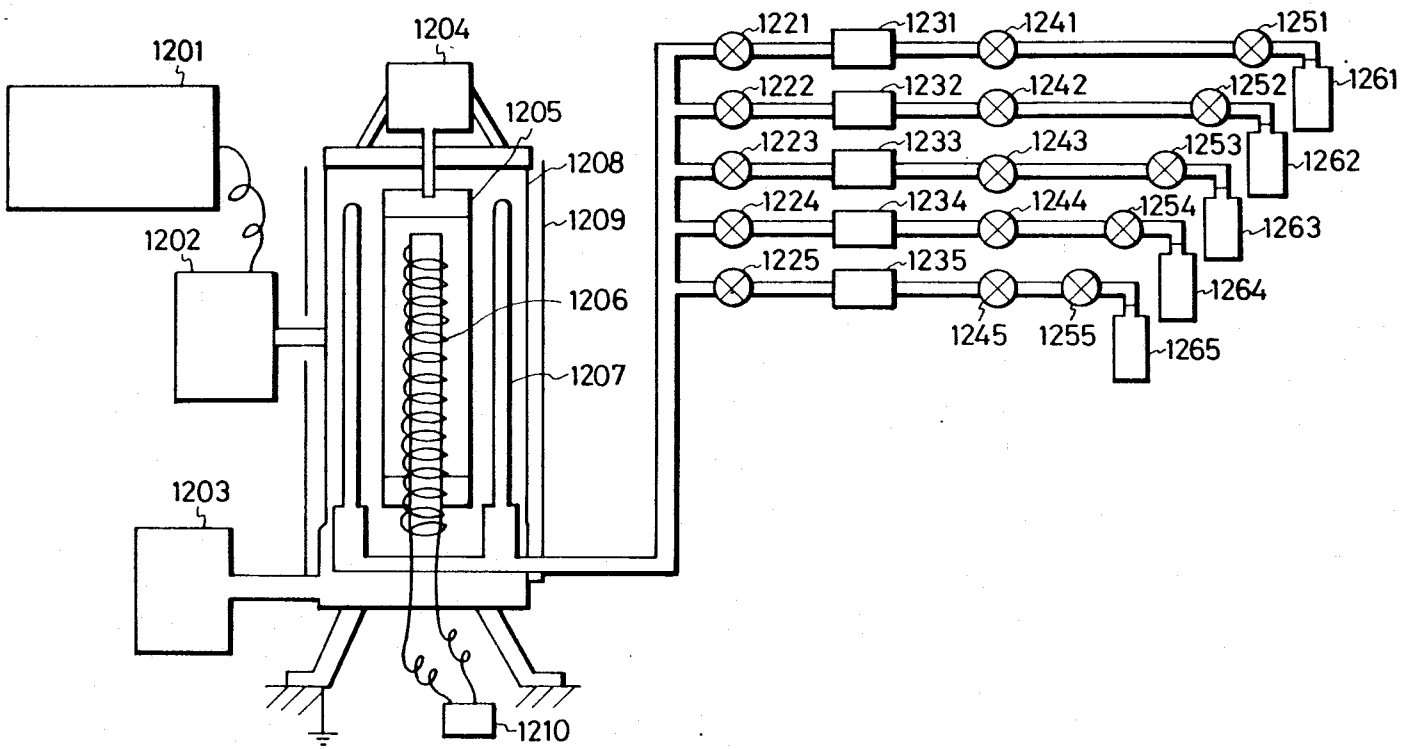
FIG. 12 is schematic illustrations of the deposition devices for preparation of the light-receiving members employed in Examples.

A charge injection-preventive layer and a photo-sensitive layer were built up on the Al substrate in the following manner with the apparatus of FIG. 12, which comprises a high frequency power source 1201, a matching box 1202, a diffusion pump 1203 combined with a mechanical booster pump, a motor 1204 for rotating an Al substrate 1205, a heater 1206 for heating the Al substrate 1205, gas feed pipes 1207, cathode electrodes 1208 for high frequency application, shield plates 1209, a power source 1210 for the heater 1206, valves 1221–1225 and 1241–1245, mass flow controllers 1231–1235, regulators 1251–1255, a hydrogen (H) cylinder 1261, a silane ($SiH_4$) cylinder 1262, a diborane ($B_2H_6$) cylinder 1263, a nitrogen oxide (NO) cylinder 1264, and a methane ($CH_4$) cylinder 1267.

Now, the operating procedures for the apparatus will be described. Valves to the cylinders 1261–1265 was all closed, and all the mass flow controllers and valves are opened. The inside pressure of the deposition apparatus was reduced to $10^{-7}$ Torr by the diffusion pump 1203 and at the same time, the Al substrate 1205 was heated to 250° C. and kept constant at 250° C. by the heater 1206. After the Al substrate 1205 was kept constant at 250° C., the valves 1221–1225, 1241–1245 and 1251–1255 were closed, and the valves to the cylinders 1261–1265 were opened, and the diffusion pump 1203 was switched to the mechanical booster the secondary pressures of valves 1251–1255 with the regulators were set to 1.5 Kg/cm$^2$. The mass flow controller 1231 was set to 300 SCCM, and the valve 1241 and the valve 1221 were successively opened to introduce a $H_2$ gas into the deposition apparatus.

Then, a $SiH_4$ gas from the cylinder 1261 was introduced into the deposition apparatus in the same operating manner as in the introduction of the $H_2$ gas by setting the mass flow controller 1232 to 150 SCCM. Then, the mass flow controller 1233 was set so that the flow rate of $B_2H_6$ gas from the cylinder 1263 could be 1600 ppm by volume on the basis of the flow rate of the $SiH_4$ gas, and the $B_2H_6$ gas was introduced into the deposition apparatus in the same manner as in the introduction of the $H_2$ gas.

After the inside pressure in the deposition apparatus was stabilized to 0.2 Torr, the high frequency power source 1201 was turned on, and a glow discharge was conducted between the Al substrate 1205 and the cathode electrode 1208 while adjusting the matching box 1202, and an A-Si:H layer, which turned a p-type A-Si:H layer containing B, was deposited with a thickness of 5 μm at the high frequency power of 150 W (charge injection-preventive layer). After the deposition of the A-Si:H layer (p-type) having the thickness of 5 μm, the valve 1223 was closed to stop the introduction of $B_2H_6$ without discontinuing the electric discharge.

Then, an A-Si:H layer (non-doped) having a thickness of 20 μm was deposited at the high frequency power of 150 W (photo-sensitive layer). Then, the high frequency power source and all the gas valves were closed, and the deposition apparatus was subjected to gas exhaustion. Then, the temperature of Al substrate was cooled down to room temperature and the substrate provided with up to the photo-sensitive layer was taken out of the depositon apparatus.

22 light receiving members provided with up to the photo-sensitive layer on the substrate were prepared in the same manner as above.

Then, the hydrogen ($H_2$) cylinder 1261 was replaced with an argon (Ar) gas cylinder, and the deposition apparatus was cleaned. Then, the material for the surface layer shown in Table 1 (condition No. 101) was laid on the entire surface of the cathode electrode. Then, one light receiving member provided with up to the photo-sensitive layer was placed in the deposition apparatus, and the inside of the deposition apparatus was subjected to thorough pressure reduction by the diffusion pump. Then, the argon gas was introduced into the deposition apparatus up to 0.015 Torr, and glow discharge was conducted at the high frequency power of 150 W to effect sputtering of the material for the surface layer and deposit the surface layer of Table 1 (condition No. 101) on the light receiving member (Sample No. 101). Surface layers were built up on the remaining 21 light receiving members under the conditions of Table 1 (conditions Nos. 102–122) to obtain samples No. 102–122.

Figure 11C:
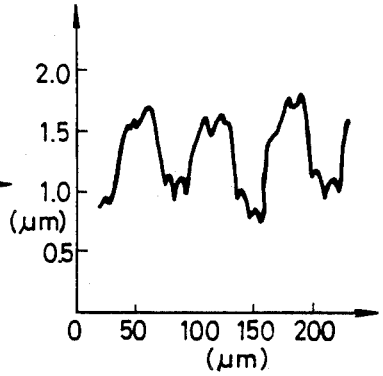

As shown in FIGS. 11 (B) and (C), the surface of the photo-sensitive layer and that of the substrate were not in parallel with each other in these samples, where the difference in average layer thickness between the Al substrates at the center and at both ends was 2 μm.

Figure 13:
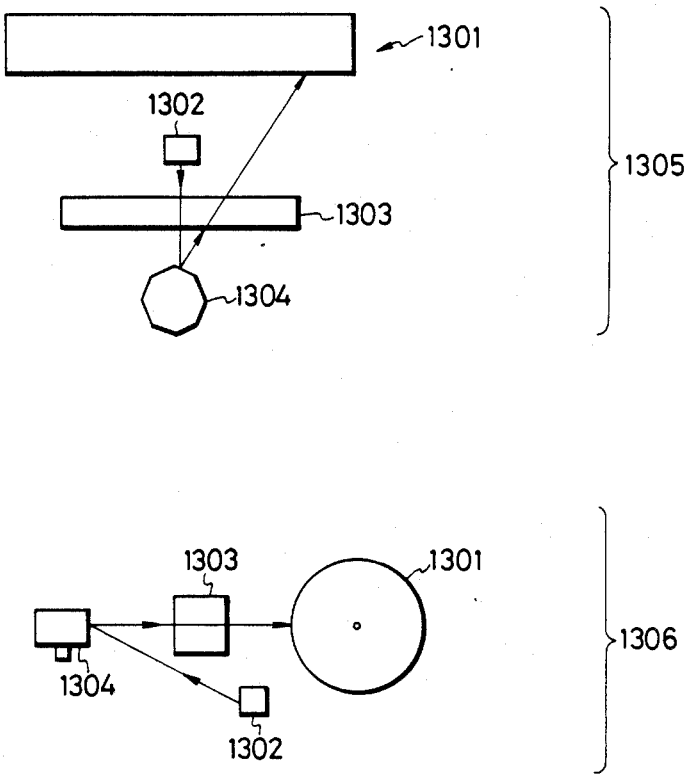
FIG. 13 is a schematic illustration of the image exposure device employed in Examples.

The thus prepared 22 light receiving members for the electrophotography were subjected to image light exposure with a semi-conductor laser having the wavelength of 780 nm with a spot size of 80 μm, using the apparatus shown in FIG. 13, and images were obtained therefrom through development and transfer In that case, no interference fringe patterns were observed and practically sufficient electrophotographic characteristics were obtained.

EXAMPLE 2

Figure 14:
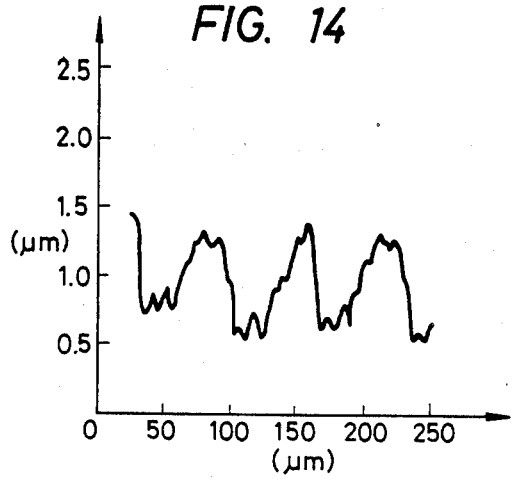

The surfaces of 22 cylindrical Al substrates were processed to the state shown in FIG. 14 by a lathe. From the individual cylindrical Al substrates were prepared light receiving members of A-Si:H for the electrophotography under the same conditions as in Example 1.

The thus prepared light receiving members for the electrophotography were subjected to image light exposure in the same manner as in Example 1, using the apparatus of FIG. 13, and images were obtained therefrom through development and transfer in these cases, the transferred image had no interference fringes and had practically sufficient characteristics.

EXAMPLE 3

Figure 15:
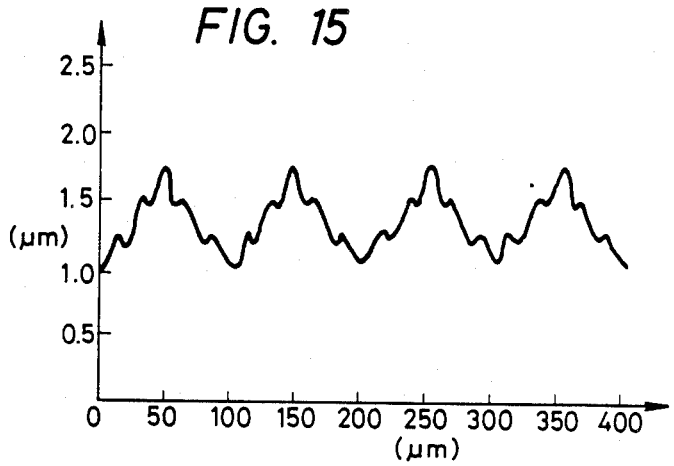
Figure 16:
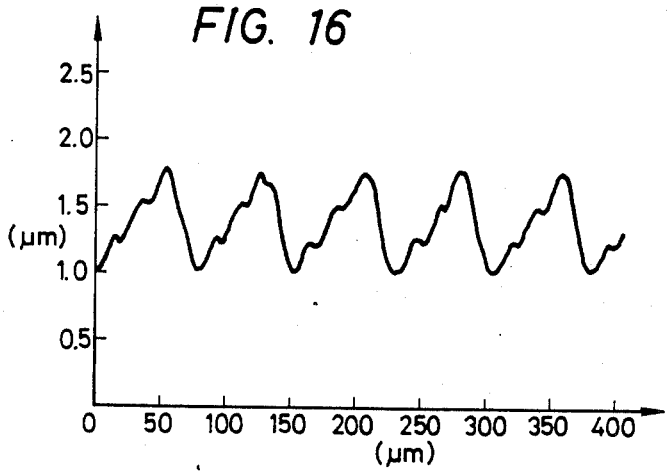

Light receiving members for the electrophotography were prepared from cylindrical Al substrates having the surface states shown in FIGS. 15 and 16 under the conditions shown in Table 2.

The thus prepared light receiving members for the electrophotography were subjected to image light exposure, using the same apparatus for image light exposure as in Example 1, and visible images were obtained therefrom on the ordinary paper through development, transfer and fixation. The image forming process was continuously repeated 100,000 times. In these cases, all the images thus obtained had no interference fringes and had fractically sufficient characteristics. Furthermore, there was no difference between the initial image and the 100,000th image, and high quality images were obtained.

EXAMPLE 4

Light receiving members for the electrophotography were prepared from cylindrical Al substrates having the surface states shown in FIGS. 15 and 16 under the conditions shown in Table 3.

The thus prepared light receiving members for the electrophotography were subjected to image light exposure, using the same apparatus for image light exposure as in Example 1, and visible images were obtained therefrom on the ordinary paper through development, transfer and fixation. In these cases, the images thus obtained had no interference fringes and had practically sufficient characteristics.

EXAMPLE 5

Light receiving members for the electrophotography were prepared from cylindrical Al substrates having the surface states shown in FIGS. 15 and 16 under the conditions shown in Table 4.

The thus prepared light receiving members for the electrophotography were subjected to image light exposure, using the same apparatus for image light exposure as in Example 1, and visible images were obtained therefrom on the ordinary paper through development, transfer and fixation. In these cases, the thus obtained images had no interference fringes, and had practically sufficient characteristics.

EXAMPLE 6

Light receiving members for the electrophotography were prepared from cylindrical Al substrates having the surface states shown in FIGS. 15 and 16 under the conditions shown in Table 5.

The thus prepared light receiving members for the electrophotography were subjected to image light exposure, using the same apparatus for image light exposure as in Example 1, and visible images were obtained therefrom on the ordinary paper through development, transfer and fixation. In these cases, the thus obtained images had no interference fringes and had practically sufficient characteristics.

TABLE 1

| Condition No. | 101 | 102 | 103 | 104 | 105 | 106 | 107 | 108 | 109 | 110 | 111 | 112 |
|---|---|---|---|---|---|---|---|---|---|---|---|---|
| Material for surface layer | $ZrO_2$ | | $TiO_2$ | | $ZrO_2/Ti$ $O_2 = 6/1$ | | $TiO_2/Zr$ $O_2 = 3/1$ | | $CeO_2$ | | ZnS | |
| Refractive index | 2.00 | | 2.26 | | 2.09 | | 2.20 | | 2.23 | | 2.24 | |
| Layer thickness (μm) | 0.0975 | 0.293 | 0.0863 | 0.259 | 0.0933 | 0.280 | 0.0886 | 0.266 | 0.0874 | 0.262 | 0.0871 | 0.261 |

| Condition No. | 113 | 114 | 115 | 116 | 117 | 118 | 119 | 120 | 121 | 122 |
|---|---|---|---|---|---|---|---|---|---|---|
| Material for surface layer | $Al_2O_3$ | | $CeF_3$ | | $Al_2O_3/Zr$ $O_2 = 1/1$ | | $MgF_2$ | | $SiO_2$ | |
| Refractive index | 1.63 | | 1.60 | | 1.68 | | 1.38 | | 1.49 | |
| Layer thickness (μm) | 0.120 | 0.359 | 0.123 | 0.366 | 0.116 | 0.348 | 0.141 | 0.424 | 0.131 | 0.393 |

TABLE 2

| Layer structure | Gas used | Flow rate (SCCM) | Flow rate ratio | Discharge power (W) | Layer-forming rate (A/sec) | Layer thickness (μm) |
|---|---|---|---|---|---|---|
| charge injection-preventive layer | $SiH_4$ $B_2H_6/H_2$ (= 3000 ppm) NO | 300 | $B_2H_6/SiH_4$ = 1600 ppm $NO/SiH_4$ = 3.4% | 150 | 10 | 5 |
| Photo-sensitive layer | $SiH_4$ $H_2$ | 300 300 | $SiH_4/H_2 = 1$ | 300 | 20 | 20 |
| Surface layer | Ar $Al_2O_3$ target | 100 | | 300 | 2 | 0.359 |

electrophotography were subjected to image light ex-

TABLE 3

| Layer structure | Gas used | Flow rate (SCCM) | Flow rate ratio | Discharge (W) | Layer-forming rate (Å/sec) | Layer thickness (μm) |
|---|---|---|---|---|---|---|
| Charge injection- | $SiH_4$ | 50 | $SiH_4/NO = 5/6$ | 100 | 3 | 0.2 |

TABLE 3-continued

| Layer structure | Gas used | Flow rate (SCCM) | Flow rate ratio | Discharge (W) | Layer-forming rate (Å/sec) | Layer thickness (μm) |
|---|---|---|---|---|---|---|
| preventive layer | NO | 60 | | | | |
| Photosensitive layer | $SiH_4$ | 300 | $SiH_4/H_2 = 1$ | 300 | 20 | 20 |
| | $H_2$ | 300 | | | | |
| Surface layer | Ar | 100 | | 300 | 2 | 0.393 |
| | $SiO_2$ target | | | | | |

TABLE 4

| Layer structure | Gas used | Flow rate (SCCM) | Flow rate ratio | Discharge (W) | Layer-forming rate (Å/sec) | Layer thickness (μm) |
|---|---|---|---|---|---|---|
| Charge injection preventive layer | $SiH_4$ | 30 | $SiH_4/NH_3 = 3/20$ | 200 | 3 | 0.2 |
| | $NH_3$ | 200 | | | | |
| Photosensitive layer | $SiH_4$ | 300 | $SiH_4/H_2 = 1$ | 300 | 20 | 20 |
| | $H_2$ | 300 | | | | |
| Surface layer | Ar | 100 | | 270 | 2 | 0.424 |
| | $CeF_3$ target | | | | | |

TABLE 5

| Layer structure | Gas used | Flow rate (SCCM) | Flow rate ratio | Discharge power (W) | Layer-forming rate (A/sec) | Layer thickness (μm) |
|---|---|---|---|---|---|---|
| charge injection-preventive layer | $SiH_4$ | 30 | $SiH_4/CH_4 = \frac{1}{20}$ | 300 | 3 | 0.3 |
| | $CH_4$ | 600 | | | | |
| Photo-sensitive Layer | $SiH_4$ | 300 | $SiH_4/H_2 = 1$ | 300 | 20 | 20 |
| | $H_2$ | 300 | | | | |
| Surface layer | Ar | 70 | | 300 | 1.7 | 0.262 |
| | $CeO_2$ target | | | | | |

What we claimed is:

1. A light-receiving member which comprises a substrate having a large number of projection parts, whose cross-sectional shape at a given cross-sectional position is a projection shape formed of a main peak and an auxiliary peak as overlapped, on the surface of the substrate, and a light-receiving layer comprising a layer containing an amorphous material including silicon atoms, at least one part of the layer region of the layer being photosensitive, and a surface layer having a reflection-preventive function.

2. A light-receiving member according to claim 1, wherein the layer region is photo-conductive.

3. A light-receiving member according to claim 1, wherein the light-receiving layer is in a multi-layer structure.

4. A light-receiving member according to claim 1, wherein the projection parts are reqularly arranged.

5. A light-receiving member according to claim 1, wherein the projection parts are arranged at constant cycles.

6. A light-receiving member according to claim 1, wherein each of the projection parts has the same shape in a linear approximation.

7. A light-receiving member according to claim 1, wherein each of the projection parts has a plurality of auxiliary peaks 8. A light-receiving member according to claim 1, wherein the cross-sectional shapes of the projection parts are symmetrical at the main peaks as a center.

9. A light-receiving member according to claim 1, wherein the cross-sectional shapes of the projection parts are asymmetrical at the main peaks as a center.

10. A light-receiving member according to claim 1, wherein the projection parts are formed by mechanical processing.

11. A light-receiving member according to claim 1, wherein the surface layer is made of an inorganic fluoride.

12. A light-receiving member according to claim 1, wherein the surface layer is made of an inorganic oxide.

13. A light-receiving member according to claim 1, wherein the surface layer is made of an inorganic nitride.

14. A light-receiving member according to claim 1, wherein the surface layer is made of an organic compound.

15. A light-receiving member according to claim 1, wherein the light-receiving layer has a charge injection-preventive layer between the substrate and the photosensitive layer.

16. A light-receiving member according to claim 15, wherein the charge injection-preventive layer contains at least one of hydrogen atoms and halogen atoms and a conductivity-controlling substance (C).

17. a light-receiving member according to claim 16, wherein the conductivity-controlling substance (C) is a p-type inpurity.

18. A light-receiving member according to claim 16, wherein the conductivity-controlling substance (C) is an n-type impurity.

19. A light-receiving member according to claim 16, wherein the content of the conductivity-controlling substance (C) contained in the charge injection-preventive layer is 0.001 to $5\times10^4$ atomic ppm.

20. A light-receiving member according to claim 16, wherein the thickness of the charge injection-preventive layer is 30 Å to 10 μm.

21. A light-receiving member according to claim 1, wherein the photosensitive layer contains a conductivity-controlling substance (C).

22. A light-receiving member according to claim 21, wherein the content of the conductivity-controlling substance (C) contained in the photosensitive layer in 0,001 to 1,000 atomc ppm.

23. A light-receiving member according to claim 1, wherein the content of the photosensitive layer is 1 to 100 μm.

24. A light-receiving member according to claim 1, wherein the photosensitive layer contains at least one of hydrogen atoms and halogen atoms.

25. A light-receiving member according to claim 1, wherein the photosensitive layer contains 1 to 40 atomic % of hydrogen atoms.

26. A light-receiving member according to claim 1, wherein the photosensitive layer contains 1 to 40 atomic % of halogen atoms.

27. A light-receiving member according to claim 1, wherein the photosensitive layer contains 1 to 40 atomic % of hydrogen atoms and halogen atoms in total.

28. An electrophotographic system which comprises a light-receiving member comprising a substrate having a large number of projection parts, whose cross-sectional shape at a given cross-sectional position is a projection shape formed of a main peak and an auxiliary peak as overlapped, on the surface of the substrate, and a light-receiving layer comprising a layer containing an amorphous material including silicon atoms, at least one part of the layer region of the layer being photosensitive, and a surface layer having a reflection-preventive function.

29. An electrophotographic image forming process comprising:

(a) applying a charging treatment to the light receiving member of claim 1;

(b) irradiating the light receiving member with a laser beam carrying information to form an electrostatic latent image; and (c) developing said electrostatic latent image.

* * * * *

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 1

Line 9, "726,768," should read --726,768;--.
Line 21, "well known" should read --well-known--.
Line 30, "semi-conduc-" should read --semiconduc---.
Line 33, "semi-conduc-" should read --semiconduc---.
Line 41, "for" should read --far--.
Line 44, "photo-sensitive" should read --photosensitive--.
Line 46, delete "to".
Line 65, "photo-sensitive" should read --photosensitive--.
Line 67, "photo-sensitive" should read --photosensitive--.

COLUMN 2

Line 12, "occurence" should read --occurrence--.
Line 21, "an" should read --a--.
Line 23, "visibible" should read --visible--.
Line 23, "so called" should read --so-called--.
Line 27, "semi-conductor" should read --semiconductor--.
Line 29, "photo-sensitive" should read --photosensitive--.
Line 31, "refering" should read --referring--.
Line 44, "conform" should read --conform to--.

COLUMN 3

Line 4, "sand blast" should read --sandblast--.
Line 17, "sports" should read --spots--.
Line 18, "lowering of substantial" should read --substantial lowering of--.
Line 25, "photo-sensitive" should read --photosensitive--.

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 3 (continued)

Line 27, "photo-sensitive" should read --photosensitive--.
Line 29, "photo-sensitive" should read --photosensitive--.
Line 32, "photo-sensitive" should read --photosensitive--.
Line 34, "roughering" should read --roughening--.
Line 44, "reflected $R_2$," should read --reflected light $R_2$,--.
Line 67, "sand blasting," should read --sandblasting,--.
Line 68, "low" should read --lot--.

COLUMN 4

Line 25, "intract" should read --interact--.
Line 30, "as occurred" should read --which occur--.
Line 31, "that is" should read --that of--.
Line 47, "Further" should read --A further--.
Line 53, "Still" should read --A still--.
Line 57, "Still" should read --A still--.

COLUMN 5

Line 39, "is schematic illustrations" should read --is a schematic illustration--.
Line 47, "OF PREFERRED" should read --OF THE PREFERRED--.
Line 55, "photo-sensitive" should read --photosensitive--.
Line 63, "an" should read --a--.
Line 64, "or" should read --on--.

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 6

Line 9, "neglibly" should read --negligibly--.
Line 58, "recording" should read --according--.
Line 60, delete "a".
Line 61, "in" should read --is--.
Line 68, "an" should read --a--.

COLUMN 7

Line 3, "less the" should read --less than--.
Line 8, "photo-sensitive" should read --photosensitive--.
Line 15, "ething," should read --etching,--.
Line 35, "straight line" should read --straight-line--.
Line 67, "dimentions" should read --dimensions--.

COLUMN 8

Line 23, "defference" should read --difference--.
Line 23, "an" should read --a--.
Line 31, "give" should read --given--.
Line 35, "$d = \frac{\lambda}{4n}$" should read --$d = \frac{m\lambda}{4n}$--.
Line 47, "photo-sensitive" should read --photosensitive--.
Line 48, "deposition" should read --deposited--.
Line 62, "material" should read --materials--.

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 9

Line 4, "subjected surface-cutting" should read --subjected to surface-cutting--.
Line 7, "change" should read --charge--.
Line 8, "photo-sensitive" should read --photosensitive--.
Line 49, "change" should read --charge--.
Line 50, "change" should read --charge--.
Line 50, "of 1001" should read --of substrate 1001--.
Line 51, "photo-sensitive" should read --photosensitive--.
Line 60, "so called inpurity" should read --so-called impurity--.
Line 60, "semi-conductor" should read --semiconductor--.
Line 61, "inpurities" should read --impurities--.
Line 62, "inpurities" should read --impurities--.

COLUMN 10

Line 1, "inpurities" should read --impurities--.
Line 17, "region" should read --regions--.
Line 30, "photo-sensitive" should read --photosensitive--.
Line 37, "subejcted" should read --subjected--.
Line 44, "photo-sensitive" should read --photosensitive--.
Line 46, "photo-carriers" should read --photocarriers--.
Line 48, "photo-sensitive" should read --photosensitive--.
Line 51, "photo-sensitive" should read --photosensitive--.
Line 66, "-presen-" should read ---preven---.
Line 67, "photo-sensitive" should read --photosensitive--.

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 11

Line 1, "photo-sensitive" should read --photosensitive--.
Line 7, "photo-sensitive" should read --photosensitive--.
Line 11, "member FIG. 10" should read --member of FIG. 10--.
Line 11, "so" should read --so---.
Line 18, "insulting" should read --insulating--.
Line 24, "semi-conductor" should read --semiconductor--.
Line 31, "photo-sen-" should read --photosen---.
Line 47, "was" should read --were--.
Line 57, "booster the" should read --booster, the--.

COLUMN 12

Line 10, "turned a" should read --formed a--.
Line 19, "(photo-sensitive" should read --(photosensitive--.
Line 24, "with up to" should read --with--.
Line 24, "photo-sensitive" should read --photosensitive--.
Line 26, "22" should read --Twenty-two--.

COLUMN 11

Line 42, "(H)" should read --($H_2$)--.

COLUMN 12

Line 26, "with up to" should read --with--.
Line 27, "photo-sensitive" should read --photosensitive--.
Line 34, "light receiving" should read --light-receiving--.
Line 34, "with up to" should read --with--.

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 12 (continued)

Line 35, "photo-sensitive" should read --photosensitive--.
Line 43, "light receiving" should read --light-receiving--.
Line 45, "light receiving" should read --light-receiving--.
Line 50, "photo-sensitive" should read --photosensitive--.
Line 54, "light receiving" should read --light-receiving--.
Line 56, "semi-conductor" should read --semiconductor--.
Line 68, "light receiving" should read --light-receiving--.

COLUMN 13

Line 7, "transfer in" should read --transfer. In--.
Line 12, "Light receiving" should read --Light-receiving--.
Line 16, "light receiving" should read --light-receiving--.
Line 24, "fractically" should read --practically--.
Line 30, "Light receiving" should read --Light-receiving--.
Line 34, "light receiving" should read --light-receiving--.
Table 2, "charge injection- " should read --Charge injection- --.

COLUMN 14

Line 9, "Light receiving" should read --Light-receiving--.
Line 13, "light receiving" should read --light-receiving--.
Line 23, "Light receiving" should read --Light-receiving--.
Line 27, "light receiving" should read --light-receiving--.
Table 2, "(A/sec)" should read --(Å/sec)--.

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 14

Table 3, "Discharge" should read --Discharge power--.
(W) (W)

COLUMN 15

Table 3, "Discharge" should read --Discharge power--.
(W) (W)
Table 4, "Discharge" should read --Discharge power--.
(W) (W)
Table 4, "injection " should read --injection---.
preventive preventive
Table 4, "Photosensitive $SiH_4$ 300"
layer $H_2$ 300
should read
--Photosensitive $SiH_4$ 300--.
layer $H_2$ 300
Table 5, "charge injection-" should read --Charge injection---.
Table 5, "Photo-sensitive" should read --Photosensitive--.
Line 36, "What we claimed is:" should read --What we claim is:--.
Line 48, "photo-conductive" should read --photoconductive--.
Line 53, "reqularly" should read --regularly--.

COLUMN 16

Table 5, "(A/sec)" should read --(Å/sec)--.
Line 59, "a" should read --A--.

UNITED STATES PATENT AND TRADEMARK OFFICE

CERTIFICATE OF CORRECTION

PATENT NO. : 4,705,730

DATED : November 10, 1987

INVENTOR(S) : KEISHI SAITOH, ET AL.

It is certified that error appears in the above-identified patent and that said Letters Patent is hereby corrected as shown below:

COLUMN 17

Line 9, "in" (second occurrence) should read --is--.
Line 10, "0,001" should read --0.001--.
Line 10, "atomc" should read --atomic--.

COLUMN 18

Line 17, "light receiv-" should read --light-receiv---.
Line 19, "light receiving" should read --light-receiving--.

Signed and Sealed this

Seventeenth Day of May, 1988

*Attest:*

*Attesting Officer*

DONALD J. QUIGG

*Commissioner of Patents and Trademarks*